United States Patent [19]

Träubel et al.

[11] Patent Number: 4,810,251

[45] Date of Patent: Mar. 7, 1989

[54] FATLIQUORING SOLUTION DISPERSION OR EMULSION AND A PROCESS FOR TREATING LEATHER THEREWITH

[75] Inventors: Harro Träubel, Leverkusen; Helmut Woynar, Dormagen; Hans-Werner Müller, Cologne; Hans J. Focks, Bergisch-Gladbach, all of Fed. Rep. of Germany

[73] Assignee: Bayer Aktiengesellschaft, Bayerwerk, Fed. Rep. of Germany

[21] Appl. No.: 858,160

[22] Filed: May 1, 1986

[30] Foreign Application Priority Data

May 17, 1985 [DE] Fed. Rep. of Germany ..... 3517803

[51] Int. Cl.[4] ..... C14C 9/02

[52] U.S. Cl. ..... 8/94.23; 8/94.2; 8/94.21; 427/389

[58] Field of Search ..... 8/94.21, 94.19 R, 94.23, 8/94.22; 427/389

[56] References Cited

U.S. PATENT DOCUMENTS

| | | | |
|---|---|---|---|
| 2,828,220 | 3/1958 | McWherter et al. | 8/94.23 |
| 3,720,606 | 3/1973 | Herney et al. | 210/11 |
| 4,190,687 | 2/1980 | Sugiura et al. | 427/389 |
| 4,345,006 | 8/1982 | Loechel et al. | 427/389 |

FOREIGN PATENT DOCUMENTS

| | | |
|---|---|---|
| 2231162 | 6/1972 | Fed. Rep. of Germany . |
| 2539671 | 7/1977 | Fed. Rep. of Germany . |
| 1573918 | 7/1969 | France . |

*Primary Examiner*—Paul Lieberman
*Assistant Examiner*—John F. McNally
*Attorney, Agent, or Firm*—Gene Harsh; Joseph C. Gil; Richard E. L. Henderson

[57] ABSTRACT

Aqueous fatliquoring solutions, dispersions or emulsions are made with (a) polyethers having at least two hydroxyl groups and a molecular weight of from 200 to 20,000 and/or (b) polyester containing at least two hydroxyl groups and a molecular weight of from 200 to 20,000 and/or (c) polycarbonates containing at least two hydroxyl groups and a molecular weight of from 200 to 20,000 and/or mixtures thereof. These fatliquoring agents are used to treat tanned leathers until from 0.1 to 20 wt % has been taken up. The thus-treated leather is particularly useful in the production of leather-polyurethane compositions such as shoes without the use of an adhesive.

15 Claims, No Drawings

FATLIQUORING SOLUTION DISPERSION OR EMULSION AND A PROCESS FOR TREATING LEATHER THEREWITH

BACKGROUND OF THE INVENTION

This invention relates to a fatliquoring composition and a process for treating leather with that fatliquoring composition.

The processing of leathers to form shoes with PUR or PVC soles directly sprayed on (i.e. without an additional adhesive bond between the sole and upper leather) has become increasingly significant in recent years, particularly in the field of sport shoes. In such processes a shoe upper is drawn over a (metal) last and the uppers are introduced into a relatively tightly closing mold. The sole is then sprayed on directly without additional bonding using a reactive polyurethane mixture or, optionally a PVC mixture. This eliminates the need for a bonding agent between upper and sole.

This process may be economically carried out when the leathers used are dressed with products which enter into a firm bond with polyurethanes under the processing conditions, (e.g., with PU-coated skivers). However, the direct spraying-on process presents difficulties when the leathers are to be naturally processed because, in most cases, the standard fatliquoring materials for leather are only superficially absorbed and therefore act like a release agent between the leather and the polyurethane. High adhesion, as required in particular for sports shoes, cannot be obtained because, under the heat effect generated during the spraying-on process, the polyurethane is unable to bind itself sufficiently firmly to the fatliquoring agent diffused onto the surface of the leather and to the leather itself.

One way of avoiding this effect is to treat the leather after fatliquoring with polycationic substances in order to fix the fatliquoring agent to the leather. However, this does not produce the desired result because the polycation-active substances are also deposited onto the leather surface (like pigments) together with the fatliquoring agents and reduce the adhesion of the PUR sole subsequently applied.

Other possibilities for improving adhesion between leather and polyurethane which have been tried include the use of fatliquoring agents which have an affinity for leather and are also capable of reacting with the isocyanate groups in the polyurethane. Although fatty acid derivatives of the type described, for example, in SU-PS No. 840,220 theoretically have these properties, these derivatives also act like a release agent due to their $C_{10}$-$C_{16}$ fatty acid residues. The nonylphenol-based Mannich bases or alkoxylation products thereof (disclosed e.g., in U.S. Pat. No. 3,720,606) which in principle may be used in the same way, have a catalytic effect on other isocyanate reactions (for example, on the NCO—OH reactions or NCO trimerization) and do not improve adhesion either. The polyglycolether amines disclosed in German Offenlegungsschrift No. 2,539,671 show similar behavior.

Until now, the only successful processes for producing upper leathers of any type for the direct spraying-on of soles required mechanically roughening the leathers by abrasion before the spraying-on process or treating the leathers with an adhesion promoter before the PUR or PVC sole was sprayed on in order to strengthen adhesion between the leather and the polyurethane.

Both processes involve additional and expensive operations.

For example, it is very difficult where the leather is mechanically roughened to confine the abrasion process to the area which will be in contact with the PUR sole. If the abrasion process exceeds those bounds, unattractive rough patches are formed on the upper leather. However, if the abrasion process falls short of those boundaries, adhesion between sole and upper is greatly reduced over the non-roughened areas.

The same problem of keeping exactly to predetermined limits also affects the second method of after-treating the upper leather before the spraying-on process (i.e., applying a suitable primer or adhesion promoter) if unattractive streaks on the upper material on the one hand and reduced adhesion of the sole on the other hand are to be avoided. Primers of this type are, for exampe, aromatic oligourethanes which generally show a pronounced tendency towards yellowing.

Unfortunately, all such attempts to make upper leathers to which a PUR sole reliably adheres in the absence of the above-mentioned labor-intensive steps of roughening or pretreatment with the primer have failed.

SUMMARY OF THE INVENTION

It has now surprisingly been found that leathers which adhere firmly to polyurethanes and which are suitable for the direct spraying-on of reactive PUR compositions can be obtained if, optionally after retanning in the usual way, the leather is treated with polyesters and/or polyethers and/or polycarbonates containing at least two (preferably aliphatically or cycloaliphatically bound) hydroxyl groups and having molecular weights of from 200 to 20,000 (preferably from 400 to 10,000) which may be converted into the aqueous phase either as such or optionally using emulsifiers and/or water-miscible solution promoters. Such treatment may be carried out either in conjunction with or instead of the normal fatliquoring agents. It has also been found that leathers treated in this way surprisingly show outstanding depth of color and evenness when dyed with standard leather dyes. Depth of color and evenness is much more favorable than in the treatment of leathers with standard fatliquoring agents.

DETAILED DESCRIPTION OF THE INVENTION

The present invention relates to a process for the fatliquoring of leather, particularly preparation of leather for the direct spraying-on of reactive polyurethane compositions with an increase in the adhesive forces of the leather/polyurethane combinations, more especially leather upper/polyurethane sole combinations. In this process, tanned leathers are treated with an aqueous bath of fatliquoring agent(s) in the form of an aqueous, optionally solvent-containing solution, emulsion or dispersion made up of (a) hydroxypolyethers containing at least two hydroxyl groups (preferably with more than three oxyalkylene groups) and having a molecular weight of from 200 to 20,000, preferably from 400 to 10,000 and more preferably from 800 to 3000 and/or (b) hydroxypolyesters containing at least two hydroxyl groups and having a molecular weight of from 200 to 20,000, preferably from 400 to 10,000 and more preferably from 800 to 3000 and/or (c) hydroxypolycarbonates containing at least two hydroxyl groups and having a molecular weight of from 200 to 20,000, preferably from 400 to 10,000 and more preferably from 800 to 3000 or (d) mixtures of components (a), (b), and/or (c) instead of or in conjunction with standard fatliquoring agents. This treatment is continued until from 0.1 to 20 wt % and preferably from 0.2 to 10 wt % of the fatliquoring agent has been taken up.

The new fatliquoring agents (a), (b), (c) and (d) of the present invention should be present in the mixture of fatliquoring agents in a quantity of from 20 to 100 wt % and preferably in a quantity of from 40 to 80 wt %.

The present invention also relates to the use of the leathers prepared by such process for the direct spraying-on of reactive polyurethane compositions to form leather/polyurethane combinations. More specifically, the present invention is directed to the use of leathers pretreated by the process according to the invention in the form of uppers for the direct spraying-on of reactive PUR compositions in automatic spraying-on machines to form adhesiveless upper leather/PU sole combinations.

Unless they are themselves soluble, emulsifiable or dispersible in water, the coapounds used in accordance with the invention may be converted into the aqueous phase by using a suitable emulsifier or by using a water-miscible solvent as solution promoter.

The hydroxypolyethers may be prepared using oxiranes such as ethylene oxide, 1,2-propylene oxide, 2,3-butylene oxide, 1,2-butylene oxide, epichlorohydrin or styrene oxide; oxetanes such as 1,3-propylene oxide: and oxolanes such as tetrahydrofuran. Such components may be reacted in accordance with known methods with difunctional or polyfunctional, hydroxyl- and/or aminofunctional starter components to form the polyethers (a) The polyethers generally contain more than three oxyalkylene groups. Suitable hydroxyl-functional (preferred) or aminofunctional (less preferred) starter components include: hydroxyl-functional starters such as water; diols (for example, ethylene glycol, 1,2-propane diol, 1,3-propane diol, 1,4-butane diol, 1,6-and 1,4-hexane diol, 3,6-dianhydrosorbitol, 4,4'-dihydroxydiphenylpropane): triols such as glycerol and trimethylol propane: higher polyols such as pentaerythritol, sorbitol, mannitol, formitol, formose and sucrose: aminofunctional starters such as methylamine, ethylene diamine or stearylamine; and also hydrazine, ethoxylmelamine, and other starters which give at least bifunctional polyethers. It is preferred to use polymerization products of ethylene oxide and propylene oxide based on starter components containing two or three hydroxyl groups. The ratio of ethylene oxide to propylene oxide should preferably be in the range from 100:1 to 30:70 and more preferably in the range from 80:20 to 40:60. It was surprising to find that polyethers based on hydroxyfunctional starters give fatliquoring agents which provide considerably improved dyeing and high evenness and fastness to rubbing of dye finishes.

Hydroxypolyethers based on aminofunctional starters often form complexes with acid dyes which complexes are deposited on the surface of the leather (in the form of dye salts) and give dye finishes with very little resistance to rubbing. In addition, the dyed leathers are difficult to acidify (poor bath utilization) and dyes are occasionally difficult to fix to the surface of the leather. In the case of polyether polyols started with relatively long chain amines (for example containing more than 10 carbon atoms), dyeing is often accompanied by foaming which ultimately results in uneven dye finishes.

The various oxiranes may be polymerized either together as a mixture or successively in one or more blocks onto the starter component or onto the preformed polyol.

The hydroxypolyesters useful in the present invention may be produced in known manner and are, for example, reaction products of polybasic, preferably dibasic carboxylic acids or mixtures thereof. Instead of using the free polycarboxylic acids, it is also possible to use the corresponding polycarboxylic acid anhydrides or corresponding polycarboxylic acid esters of lower, monohydric alcohols or mixtures thereof for producing the polyesters. The polycarboxylic acids may be aliphatic, cycloaliphatic, aromatic, araliphatic and/or heterocyclic and may optionally be substituted (for example, by halogen atoms, such as chlorine or bromine) and/or unsaturated.

Examples of such carboxylic acids and derivatives thereof include: succinic acid, adipic acid, suberic acid, azelaic acid, sebacic acid, phthalic acid, isophthalic acid, trimellitic acid, phthalic acid anhydride, tetrahydrophthalic acid anhydride, hexahydrophthalic acid anhydride, tetrachlorophthalic acid anhydride, endomethylene tetrahydrophthalic acid anhydride, glutaric acid anhydride, maleic acid, maleic acid anhydride, fumaric acid, dimerized and trimerized unsaturated fatty acids, optionally in admixture with monomeric unsaturated fatty acids, such as oleic acid, terephthalic acid dimethylester and terephthalic acid-bis-glycolester.

Suitable polyhydric alcohols, optionally in admixture with one another, include: ethylene glycol; 1,2- and 1,3-propane diol: 1,4- and 2,3-butane diol; 1,6-hexane diol; 1,8-octane diol; neopentyl glycol; 1,4-bis-hydroxymethylcyclohexane: 2-methyl-1,3-propane diol: N,N-bis-(2-hydroxypropyl)-N-methylamine: glycerol; trimethylol propane; 1,2,6-hexane triol; 1,2,4-butane triol; trimethylolethane; pentaerythritol; quinitol; mannitol; sorbitol: formitol; methylglycoside: dianhydrohexitols: particularly di-, tri- and tetraethylene glycols and higher polyethylene glycols; di-, tri- and higher polypropylene glycols and also dibutylene glycol and higher polybutylene glycols.

The low molecular weight polyols may also be reacted in admixture with one another by esterification. The polyesters used may also contain carboxyl groups as terminal groups.

It is also possible to use polyesters of lactones (for example, caprolactone), and hydroxycarboxylic acids (for example, $\beta$-hydroxycaproic acid) either on their own or in admixture with polyhydroxyl compounds for producing the polyesters. Preferred polyesters are hydrophilic polyesters and hydrophilic polycarbonates produced using di-, tri-, tetra- or polyethylene glycols.

Other polycarbonates which may also be used include reaction products of polyhydric (preferably dihydric and, optionally, trihydric or tetrahydric) alcohols with certain carbonic acid derivatives (such as phosgene, chloroformic acid phenylester, chloroformic acid ethylester, but especially diphenyl carbonate, diethyl carbonate, ethylene carbonate, propylene carbonate and pyrocarbonic acid dimethylester) produced in accordance with known methods.

Mixed esters of polylactones and esters or polycarbonates or mixtures of polyesters, polylactones and/or polycarbonates may also be used. Unless they are themselves soluble, emulsifiable or dispersible in water, the polyethers, polyesters or polycarbonates according to the invention may be converted into the aqueous phase by addition of standard emulsifiers. The emulsifiability of polyesters, polylactones, polycarbonates or polyethers is also simplified by incorporation of small quantities of ionizable groups (cationic or anionic) or of tertiary amines capable of forming salts.

Suitable external emulsifiers are long-chain alkylsulfates and alkylsulfonates; ethoxylation products of alkylphenols (for example, p-nonylphenol), of aromatically substituted phenols (such as phenylphenol), of alkylation or benzylation products of phenylphenols, long-chain alkylcarboxylic acids or quaternized long-chain alkylammonium salts.

The fatliquoring solutions, emulsions or dispersions of the invention may be used together with or instead of the known fatliquoring agents. The quantity in which the known fatliquoring agents are used is generally limited to quantities of less than 80 wt % of total fatliquoring agent.

The object of fatliquoring leather is to provide leather with its ultimate softness before and, above all, after dyeing. In many cases, the fatliquoring agents attach themselves to the surface of the leather in such a way that subsequent processes, such as dressing or, more particularly, the direct spraying-on of polyurethane soles, are seriously impeded. In such cases, the fatliquoring agents act as release agents. The fatliquoring agents of the present invention are not attended by these disadvantages. Their use represents a significant improvement in the processing of the leathers treated with them. In addition, the leathers treated with them may be dyed very evenly with considerable depths of color. After fatliquoring, the leathers may be treated in the usual way, for example dried, staked and, optionally dressed by known methods.

Reactive polyurethane compositions may then be directly sprayed onto the leathers fatliquored and prepared in accordance with the invention. It has also been found that, depending upon the plasticizers used, such leathers are also suitable for the spraying-on of PVC or may be processed by conventional methods after dressing.

It does not matter whether a polyether- or polyester-based reactive polyurethane mixture is sprayed onto the leathers treated in accordance with the invention. However, it has been found that very good adhesion values are obtained when the fatliquoring agent of the present invention and the reactive polyurethane mixture are made of products from the same class (for example, a combination of polyether fatliquoring agents with reactive polyether polyurethane mixtures; but preferably, polyester fatliquoring agents with reactive polyester polyurethane mixtures, the polyesters including the polylactones and polycarbnnates).

Particularly firm adhesion is obtained where hydroxyl polycarbonates, especially hydroxypolyalkylene oxide polycarbonates are used as fatliquoring agents. When these polycarbonates are used, adherence obtained with the reactive polyurethane compositions sprayed on is largely unaffected by the particular type of polyurethane reaction mixture used. The fatliquoring agents (a) through (d) of the present invention are generally used in that field of leather manufacture known as "wet dressing", i.e. retanning/fatliquoring. Examples of application are given in the following Examples.

The results obtained by the present invention are dependent on the type of leather, the type of tanning and also on the type of fatliquoring agent and reactive polyurethane mixture sprayed on.

Chrome-tanned leathers, for example, are washed, neutralized (to pH 4.5–6.0), treated with from 2 to 20 wt % of vegetable, mineral or organosynthetic retanning agents and optionally dyed. The leathers are then fatliquored with from 0.1 to 20 wt % (based on the pared weight of the leather) of the fatliquoring solution dispersion or emulsion of the invention, optionally in conjunction with standard commercially available fatliquoring agents, and finished in the usual way. Processing of the leathers is carried out in automatic machines of the type normally used in the shoe industry.

As described above, the uppers are made from the leathers, a lining (generally of fabric) is sewn in, the uppers are drawn over a (metal) last and the polyurethane compositions (soles) are then sprayed on in suitable automatic machines.

The reactive polyurethane mixtures contain the usual starting components such as relatively high molecular weight compounds containing at least 2 (preferably 2 to 4) NCO—reactive terminal groups, such as terminal OH—, $NH_2$—, NHR—, COOH or —$CONHNH_2$— groups and a molecular weight of from about 400 to 10,000; the usual aliphatic, cycloaliphatic, aromatic or heterocyclic polyisocyanates and, optionally, low molecular weight chain-extending agents containing the abovementioned terminal groups and having molecular weights of 18, 32 to 399 (for example, water, di-/polyols and di-/polyamines and other known chain extending agents). The polyhydroxyl compounds may also be more complicated natural substances, such as castor oil or modified linseed oil. In addition, the reactive mixtures may contain the usual PU catalysts and other standard additives and auxiliaries such as pigments, fillers, fibers, tubular glass beads, blowing agents, stabilizers, dyes and the like. Instead of using the polyisocyanates, it is also possible to use NCO prepolymers or semiprepolymers. The NCO indices may be varied within the usual limits, for example from 60 to 125 and prferably from 90 to 115. The spraying process may be carried out by automatic metering and mixing of the reaction components, preferably on a timed basis. The density of the polyurethane elastomers formed from the reactive polyurethane compositions may range from 800 kg/$m^3$ (cellular elastomers) to the homogeneous density of the polyurethane elastomer composition.

One example of a reactive polyether urethane composition suitable for spray-on soles is made up of 100 parts of a branched polyethylene-polypropylene glycolether (OH number 120) containing 0.5 to 3% of catalyst mixed with 42 parts of a commercial, liquid isocyanate based on 4,4'-diisocyanatodiphenylmethane (approx. 23% NCO). The resulting mixture may be introduced into a sole mold at a mold temperature of from 50 to 55° C. After about 3 to 5 minutes, the upper/sole combination can be removed from the mold. The sole adheres firmly to the upper throughout, but especially at the tip and in the tread zone.

One example of a reactive polyester urethane mixture (PES) useful for the production of shoe soles is made up of 40 parts of 4,4'-diisocyanatodiphenylmethane added to 55 parts of a partly branched diethylene glycol polyadipate (OH number 60). The resulting mixture is introduced into the mold in the same way as described above.

The invention is further illustrated, but is not intended to be limited by the following examples in which all parts and percentages are by weight unless otherwise specified.

EXAMPLES

1. Fatliquoring agents according to the invention

EXAMPLE 1.1

6 kg of a commercial, linear polyether (molecular weight 2000) based on a polyoxvpropylene/oxyethylene diol containing 15% by weight of terminal oxyethylene groups (PU 0549, Bayer AG, D-5090 Leverkusen) were dissolved in 4 kg of warm water.

EXAMPLE 1.2

3.6 kg of the polyether of Example 1.1 containing terminal oxyethylene groups and 0.4 kg of a commercial, linear polyoxypropylene ether diol (molecular weight 2000) were mixed together.

EXAMPLE 1.3

500 g of a hydroxypolycarbonate based on hexane diol polycarbonate (molecular weight 1800) were dispersed in 600 g of water using 10 g of an emulsifier based on 3-benzyl-4-hydroxybiphenolpolyglycolether. An emulsion was formed.

EXAMPLE 1.4

500 g of a bifunctional polydiehylene glycol adipate (molecular weight 2000) were dissolved in 100 g of diacetone alcohol and the resulting solution converted into an emulsion with 10 g of an emulsifier based on stearylamine and 8 moles of ethylene oxide and 500 g of water.

EXAMPLE 1.5

500 g of a difunctional mixed ether of adipic acid, hexane diol/neopentylglycol (ratio 5:7), molecular weight 1700, were converted into the aqueous phase with 10 g of an emulsifier based on stearylamine and 8 moles of ethylene oxide.

EXAMPLE 1.6

500 g of a linear polyether based on an oxyethylene/oxypropylene mixed ether (molecular weight 4000) and 18 wt % of terminal oxyethylene groups were dispersed in 500 g of water using 10 g of the emulsifier described in Example 1.5 and 100 g of ethylglycol.

EXAMPLE 1.7

200 g of the polyester of adipic acid, hexane diol and neopentyl glycol of Example 1.5 were dispersed in 592 g of water using 200 g of the same polyether as in Example 1.1 (molecular weight 4000).

EXAMPLE 1.8

200 g of the same polyester as in Example 1 5 and 200 g of the same polyether as in Example 1.1 were emulsified in water with 8 g of 3-benzyl-4-hydroxydiphenylpolyglycolether as emulsifier to form an emulsion having a solids content of 25%.

EXAMPLE 1.9

200 g of the same polyester as in Example 1.5 were emulsified in water with 200 g of a trimethylolpropane-started polyoxypropylene ether and 8 g of the same emulsifier as in Example 1.8 to form a 22% emulsion.

EXAMPLE 1.10

A bifunctional triethylene glycol polycarbonate (molecular weight 2000) was stirred with 2% of the same emulsifier as in Example 1.8 to form a 50% emulsion.

2. APPLICATION EXAMPLES 2.1 Chrome upper leather with polymer retanning

A chrome-tanned leather was treated for 30 minutes with 200% water (45° C) containing 0.2% of 10% acetic acid with 2.5% of a highly light stable substitute tanning agent (Tanigan 3LN, Bayer AG, Leverkusen). The liquor was then drained off, after which the leather was washed and then treated with another 200% of water (45° C) containing 1.5% of a neutralizing syntan (Tanigan PC , Bayer AG, Leverkusen) and 0.5% of sodium bicarbonate. The pH was adjusted to 4.6. After 45 minutes, the liquor was drained off. In the absence of liquor, the leather was then treated with 3% of a 40%, partly neutralized polymethacrylic acid (Baytigan AR®, Bayer AG, Leverkusen) diluted with water in a ratio of 1:4 and with 2% of a retanning agent based on a 40% polyester carboxylic acid (Levotan®-C, Bayer AG, Leverkusen) diluted with water in a ratio of 1:4. After 30 minutes (pH 4.7), 0.5% of a 60% cationic fatliquoring agent based on synthetic fatty compounds (Eucoriol®-KSP, Stockhausen, Krefeld) diluted with water in a ratio of 1:4 was added. After another 20 minutes, 2% of a light stable dispersant based on sulfonic acid (Baykanol®-HLX, Bayer AG, Leverkusen) was added. After 10 minutes, 9% of a light stable substitute tanning agent (Tanigan®-LD) was added and, after another 45 minutes, the liquor was drained off. The leather was then washed twice with 100% of water at 50° C.

Comparable halves were treated on the one hand with a well known and effective fatliquoring mixture (Coripol-DX-902, Stockhausen, sperm oil substitute Chromopol-UFB/W +chloroparaffin Coripol-ICA, Stockhausen, Krefeld—8% regenerated fat) and, on the other hand, with 4% of the fatliquoring mixture of Example 1.1 according to the invention.

Samples of leather treated with these fatliquoring materials were sprayed with the reactive polyether (PE) polyurethane sole mixture described above on page 12 at lines 12–18 and also with the reactive polyester urethane mixture (PES) (described above on page 12 at lines 24–28). The fatliquored leathers were combined with the reactive polyurethane mixtures in the form of upper +sole in an automatic machine.

The results obtained were as follows:

| | Separation force leather/PU sole (in N/cm) | | |
|---|---|---|---|
| Spraying on reactive PU mixture | Comparison fatliquoring product | Fatliquoring product of Example 1.1 | Fatliquoring product of Example 1.2 |
| Type: | | | |
| Polyether (PE) | 15 | 25 | No example |
| Polyester (PES) | 25 | 31 | 33 |

The leather was directly sprayed on without roughening. The separation force of the PU sole mixture on the leather (in N/cm) was determined with a tear strength tester in accordance with DIN 53 328.

EXAMPLE 2.2

Milled shoe napa/chromeless retanning

| | | | |
|---|---|---|---|
| Material | | chrome tanned cowhides pared thickness: 1.0–1.4 mm percentages based on pared weight | |
| Washing | 200% | water 40° C. | 10 mins. |
| | | drain off liquor | |
| Neutralization | 100% | water 40° C. | 30 mins. |
| | 2.0% | neutralizing syntan (Tanigan ®-PC) | |
| | | liquor - pH: approx. 4.6 | |
| Dyeing | +2.0% | light-stable dispersant based on sulfonic acid (Baykanol ®-HL) | 20 mins. |
| | 1.0% | Direct Brown 214 | |
| Retanning | +4.0% | polymethacrylic acid (Baytigan ®-AR) | 30 mins. |
| | 4.0% | polyester carboxylic acid | |
| | | liquor - pH: approx. 4.5 (Levotan ®-C) | |
| | +3.0% | light-stable substitute tanning agent (Tanigan ®-3 LN) | 30 mins. |
| | | liquor - pH: approx. 4.3 | |
| | | drain off liquor | |
| Wash | 200% | water 50° C. | 10 mins. |
| | | drain off liquor | |
| Fatliquoring: | | | |
| (a) Fatliquoring 1 (Comparison) | | | |
| | 100% | water 50° C. | |
| with 6% fat content | 5.0% this mixture containing 60% fat content | synthetic fatliquoring agent (Coripol-DX 902) | 1:4 in water |
| | 4.0% | sperm oil substitute (Chromopol UFB.W) | |
| | 1.0% | chloroparaffin (Coripol-ICA) | 40 mins. |
| | | liquor - pH: approx. 4.3 | |
| | +0.5% | formic acid 85% (1:10) | 15 mins. |
| | | liquor - pH: approx. 3.8 | |
| | | rinse at 20° C. | 5 mins. |
| | | leather to block, stretch, vacuum dyr for 1.5 mins. at 70° C., hand dry, condition, stake, mill, stretch. | |

(b) Fatliquoring 2 (according to the invention) The procedure of 2.2(a) was repeated on comparision leather using 12.5% of the product of Example 1.3.

(c) Fatliquoring 3 (according to the invention) The procedure of 2.2(a) was repeated on comparison leather using 12% of the product of Example 1.4.

The leathers were dyed with leather dyes. With the leather fatliquored in accordance with the invention (fatliquoring 2 or 3), very full or full dyeing of the leather was obtained with an even to very even dye finish. By contrast, the depth of color obtainable on the comparison leather with Fatliquoring Agent 1 was very poor (light) for only moderate evenness.

Using a standard spraying-on machine, the fatliquored leathers of 2.2(a), (b) and (c) treated with fatliquoring agents 1,2 and 3 were sprayed with reactive polyurethane mixtures a or b (see page 12). The results of the spray-on tests were as follows:

Separation forces leather/PU soles (in N/cm)

| Spraying on reactive PU mixture | Fatliquoring product 1 (comparison) | Fatliquoring product 2 (according to the invention) | Fatliquoring product 3 (according to the invention) |
|---|---|---|---|
| Type: | | | |
| Polyether (PE) (formulation a) - see page 12, lines 12–23 | 12 | 18 | 16 |
| Polyether (PES) (formulation b) - see page 12, lines 24–30 | 25 | 53 | 36 |

According to the invention, the separation forces between the sprayed-on soles and the fatliquored leathers showed distinctly higher values, particularly when ether- or ester-based products were used both for fatliquoring and for the reactive PU mixtures.

EXAMPLE 2.3

Soft upper leather/full-grained or abraded

| | | | |
|---|---|---|---|
| Material | | chrome-tanned cowhides pared thickness: 1.2–2.0 mm percentages | based on pared weight leather not prerinsed |
| Neutralization | 200% | water 50° C. | 20 mins. |
| | 2.0% | neutralized syntan (Tanigan ® PAK) | |
| Dyeing | +0.2% | leather dye, dissolved with heating Acid Black 210 | 20 mins. |
| Pre-oiling | +0.5% | fish oil (85%) (Cutisan ® TMU) | 15 mins. |
| Retanning | +5.0% | substitute taning agent (Tanigan ®-BN) | |
| | 3.0% | chromium-syntan mixture (Blancorol-RN) | |

-continued

| EXAMPLE 2.3 | | | |
|---|---|---|---|
| | 3.0% | mimosa extract | 60 mins. |
| | | liquor pH: approx. 4.0 | |
| | | drain off liquor | |
| Washing | 200% | water 60° C. | 10 mins. |
| | | drain off liquor | |
| Charge reversal | 200% | water 60° C. | |
| | 1.0% | cationic solid (1:4) | |
| | | Euroriol ® KSP, Stockhausen | 3 mins. |
| | +0.8% | dicyanodiamine resin (1:5) | |
| | | (Retingen ®R4-B) | 20 mins. |
| | | liquor pH: approx. 4.3 | |
| | | drain off liquor | |
| Overdyeing | 200% | water 60° C. | |
| | 0.8% | leather dye, dissolved with heating | 20 mins. |
| Fatliquoring: | | | |
| (a) Fatliquoring 1 (Comparison) | | | |
| | +4.0% | synthetic fatliquoring agent | |
| | | (60%) (Coripol ®-DXU) | |
| | 2.0% | fish oil (80%) (Cutisan ®-TMU) (1:4) | |
| | 0.5% | chloroparaffin (65%) (Coripol ® ICA) | 45 mins. |
| | | liquor pH: approx. 4.3 | |
| | | rinse at 20° C. | 5 mins. |
| | | Leather to block, stretch, vacuum dry for 1.5 mins. at 70° C. hang dry, condition, stake, air, restake, vacuum dry for 30 secs. at 70° C. | |

(b) Fatliquoring 2 10% of the product of Example 1.4.
(c) Fatliquoring 3 10% of the product of Example 1.6.
(d) Fatliquoring 4 10% of the product of Example 1.5.

| Spraying on of reactive PU mixture | Separation forces leather/PU soles (in N/cm) | | | |
|---|---|---|---|---|
| | Fatliquoring product 1 (comparison) | Fatliquoring product 2 | Fatliquoring product 3 | Fatliquoring product 4 |
| Type: | | | | |
| Polyether (PE) (formulation a) | 14 | 26 | 33 | 16 |
| Polyester (PES) (formulation b) | 12 | 14 | 18 | 38 |
| Dyeing Evenness | pale tendentially uneven | deep dyeing even dyeing | full dyeing average evenness | full dyeing average evenness |

EXAMPLE 2.4

Examples 2.1 and 2.2 were repeated varying the fatliquoring products according to the invention as follows (as emulsions, used with addition of emulsifier). The results are shown in the following Table.

| Retanning in accordance with Examples 2.1 & 2.2 | Fatliquoring with fatliquoring product 1 in the Examples | Fatliquoring with the product of Example No. | Dyeing depth of color | Evenness | Adhesion to reactive polyether-PU (PE,a) (N/cm) | Adhesion to reactive polyether-PU (PES,b) (N/cm) |
|---|---|---|---|---|---|---|
| Leather | | | | | | |
| 2.1 | comparison | — | light | moderate | 15 | — |
| 2.1 | — | 1.10 | full | very even | 19 | — |
| Leather | | | | | | |
| 2.2 | comparison | — | very light | even | 7 | — |
| 2.2 | — | 1.9 | full | even | 13 | 26 |
| 2.2 | — | 1.8 | very full | even | 13 | — |
| 2.2 | — | 1.7 | very full | very even | 9 | — |

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A process for treating tanned leathers in which tanned leather is treated with an aqueous fatiquoring solution, emulsion or dispersion containing (a) 20–100 wt. % of a hydroxypolyether containing at least two hydroxyl groups and having a molecular weight of from 200 to 20,000 as fatliquoring agent or (b) 20–100 wt. % of a hydroxypolyester containing at least two hydroxyl groups and having a molecular weight of from 200 to 20,000 as fatliquoring agent or (c) 20–100 wt. % of a hydroxypolycarbonate containing at least two hydroxyl groups and having a molecular weight of from 200 to 20,000 as fatliquoring agent or (d) 20–100 wt. % of a mixture of (a) and (b), (b) and (c), (a) and (c) or (a), (b) and (c) as fatliquoring agent, (e) the balance being water, until from 0.1 to 20 wt. % (based on the pared weight of the leather) of the fatliquoring solution, emulsion or dispersion has been taken up.

2. The process of claim 1 in which the aqueous fatliquoring solution, emulsion or dispersion contains a water miscible solvent.

3. The process of claim 1 in which the aqueous fatliquoring solution, emulsion or dispersion is used in conjunction with another different fatliquoring agent.

4. The process of claim 1 in which (a) and/or (b) and/or (c) has a molecular weight of from 400 to 10,000.

5. The process of claim 1 in which the tanned leather is treated until from 0.2 to 10 wt % of the fatliquoring solution, emulsion or dispersion is taken up.

6. The process of claim 5 in which (a) and/or (b) and/or (c) has a molecular weight of from 800 to 3000.

7. The process of claim 1 in which (a) and/or (b) and/or (c) has a molecular weight of from 800 to 3000.

8. The process of claim 1 in which the aqueous fatliquoring solution, emulsion or dispersion contains a hydroxyppolyether formed from a starter component selected from the group consisting of water, diols, polyols and mixtures thereof with an oxirane and/or oxolane and/or oxethane and/or a mixture thereof.

9. The process of claim 1 in which the aqueous fatliquoring solution, emulsion or dispersion contains a hydrophilic hydroxypolyether in which at least 30% oxyethylene groups are present.

10. The process of claim 1 in which the aqueous fatliquoring solution, emulsion or dispersion contains a hydrophilic hydroxypolyester and/or hydroxypolycarbonate formed from di- or poly-ethylene glycols.

11. An aqueous fatliquoring solution, emulsion or dispersion made up of (a) 20–100 wt. % of a hydroxypolyether containing at least two hydroxyl groups and having a molecular weight of from 200 to 20,000 as fatliquoring agent or (b) 20–100 wt. % of a hydroxypolyester containing at least two hydroxy groups and having a molecular weight of from 200 to 20,000 as fatliquoring agent or (c) 20–100 wt. % of a hydroxypolycarbonate containing at least two hydroxyl groups and having a molecular weight of from 200 to 20,000 as fatliquoring agent or (d) 20–100 wt. % of a mixture of (a) and (b) or (b) and (c) or (a) and (c) or (a) , (b) and (c) as fatilquoring agent and (e) the balance being water.

12. The composition of claim 11 which further includes a water miscible solvent.

13. The composition of claim 11 in which (a) and/or (b) and/or (c) has a molecular weight of from 800 to 3000.

14. The composition of claim 11 in which a hydrophilic hydroxypolyether having at least 30% oxyethylene groups is present.

15. The composition of claim 11 in which a hydrophilc hydroxypolyester and/or hydrophilic hydroxypolyarbonate formed from di- or poly-ethylene glycols is present.

* * * * *